US005077857A

United States Patent [19]

Sellers

[11] Patent Number: 5,077,857

[45] Date of Patent: Jan. 7, 1992

[54] POLISHING TOOL

[76] Inventor: Don Sellers, 1430 Kenwood Ave., Camden, N.J. 08103

[21] Appl. No.: 597,950

[22] Filed: Oct. 10, 1990

[51] Int. Cl.[5] ..... A47L 13/12

[52] U.S. Cl. ..... 15/107; 15/105; 15/114; 15/118; 15/210 R

[58] Field of Search ..... 15/105, 107, 111, 113, 15/114, 117, 118, 159 R, 160, 210 R

[56] References Cited

U.S. PATENT DOCUMENTS

| | | | |
|---|---|---|---|
| 731,583 | 6/1903 | Love | 15/107 |
| 1,870,057 | 8/1932 | Levin | 15/107 |
| 4,167,796 | 9/1979 | DePamphilis | 15/114 |

FOREIGN PATENT DOCUMENTS

| | | | |
|---|---|---|---|
| 526886 | 3/1954 | Belgium | 15/118 |
| 158500 | 2/1933 | Switzerland | 15/160 |
| 353140 | 5/1961 | Switzerland | 15/114 |
| 2601 | of 1855 | United Kingdom | 15/160 |
| 8804 | of 1888 | United Kingdom | 15/159 R |
| 14086 | of 1909 | United Kingdom | 15/114 |
| 139884 | 3/1919 | United Kingdom | 15/113 |
| 354636 | 8/1931 | United Kingdom | 15/105 |
| 554286 | 6/1943 | United Kingdom | 15/117 |

*Primary Examiner*—Philip R. Coe
*Assistant Examiner*—Mark Spisich
*Attorney, Agent, or Firm*—Norman E. Lehrer; Franklyn Schoenberg

[57] ABSTRACT

A polishing tool for automobiles is provided having a main body of bristles and a crevice tool on opposite sides of a brush block and a handle with a further cleaning medium which has a multitude of uses including removing accumulations of foreign matter from generally inaccessible crevices on the surface of an automobile by simply reversing the head or the handle when cleaning and polishing the outside of an automobile. The polishing tool can be readily used with damaging painted or plated surfaces of the automobile.

14 Claims, 1 Drawing Sheet

POLISHING TOOL

FIELD OF THE INVENTION

The present invention relates to cleaning and polishing tools and, more particularly, to tools for use in cleaning and polishing automobile body surfaces and the like.

BACKGROUND OF THE INVENTION

As is well known, it is important that significant care be exercised in polishing and maintaining the cleanliness of the exterior surfaces of vehicles such as automobiles in order to preserve the service life and appearance of the painted and plated parts. The accomplishment of this, however, is at best somewhat difficult due to the irregular and intricate designs of many of such parts and the assembled combinations thereof.

The accumulations of foreign matter including dried wax in the many corners and crevices that are present on the exterior surfaces of an automobile are generally not accessible to the varied assortment of brushes, sponges and the like typically used for washing and/or polishing automobile surfaces. Heretofore, a variety of devices, including brushes intended for multiple purposes and for use on components of various forms and shapes have also been known such as disclosed, for example, in U.S. Pat. No. 216,123 to Zuenkeler; U.S. Pat. No. 1,012,281 to Schiebel; U.S. Pat. No. 1,409,229 to Moore; U.S. Pat. No. 1,510,898 to Nikicser; U.S. Pat. No. 2,190,277 to Viragh; and U.S. Pat. No. 4,842,132 to Wells. However, none of these devices are particularly adapted for polishing the exterior surfaces of automobiles or for removing foreign matter accumulated in inaccessible areas on such surfaces. In fact, it is noted that some of the devices disclosed include components which could be harmful to the painted or plated exterior surfaces of an automobile.

SUMMARY OF THE INVENTION

It is accordingly an object of the present invention to provide a tool having a simple unitary structure which is capable of efficiently and effectively cleaning accumulations of foreign matter from generally inaccessible areas on the exterior surfaces of vehicles such as automobiles and the like during the polishing or waxing of such surfaces.

It is another object of the present invention to provide a tool which is capable of efficiently and effectively cleaning wax residue and the like foreign matter accumulations from crevices and similar inaccessible areas on the exterior surfaces of automobiles during the polishing or waxing of such surfaces without the danger of scratching or otherwise damaging the painted or plated surfaces.

It is a further object of the present invention to provide a tool of simple unitary structure having a crevice or the like cleaning device which is adapted for effectively cleaning wax residue and the like accumulations from inaccessible areas on the exterior surface of an automobile during cleaning and polishing the surface with a wax compound without damaging any portion of the surface thereof, and in combination therewith a body of bristles effectively arranged for removing the accumulations of wax residue and the like from the exterior surface of the automobile.

It is a still further object of the present invention to provide a tool of simple unitary structure suitable for use on the exterior surface of an automobile having a crevice cleaning device adapted for effectively removing wax residue and like accumulations from inaccessible areas on the exterior surface of an automobile during cleaning and polishing the surface with a waxing compound, a body of bristles for removing wax and other foreign matter residue from the exterior surface of an automobile and separate absorbent medium for the application of water and/or other cleaning, polishing or waxing fluids to the surface of an automobile independent of the means for removal of foreign matter accumulations including waxing compound reside.

In accordance with the present invention there is provided a polishing tool suitable for removing accumulations of wax residue and the like foreign matter from inaccessible areas of the exterior surface of an automobile comprising a brush block having a handle projecting axially from one end thereof, said brush block having a substantially flat first side with a plurality of bristles projecting outwardly therefrom and an opposite second side with the surface thereof tapered to a central outwardly projecting knife-like edge along the longitudinal axis thereof with a resilient, felt-like covering secured thereabout.

In another aspect of the invention there is provided a polishing tool comprising a brush block having a handle projecting from one end and the other end terminating in substantially the shape of a wedge, said brush bloc having a substantially flat first side extending from the wedge-shaped end with a plurality of bristles projecting outwardly therefrom and an opposite second side with the surface tapered to an essentially central, outwardly projecting knife-like edge extending along the longitudinal axis thereof in axial alignment with the wedge-shaped end with a resilient, felt-like covering mounted thereabout; said handle having an absorbent covering mounted about the end thereof opposite the end secured to said bristle block.

Other objects, features and advantages will be readily apparent from the following detailed description of a preferred embodiment thereof taken in conjunction with the drawing.

BRIEF DESCRIPTION OF THE DRAWING

For the purpose of illustrating the invention, there is shown in the accompanying drawing one embodiment which is presently preferred; it being understood that the invention is not intended to be limited to the precise arrangements and instrumentalities shown.

DESCRIPTION OF THE PREFERRED EMBODIMENT

Figure 1:
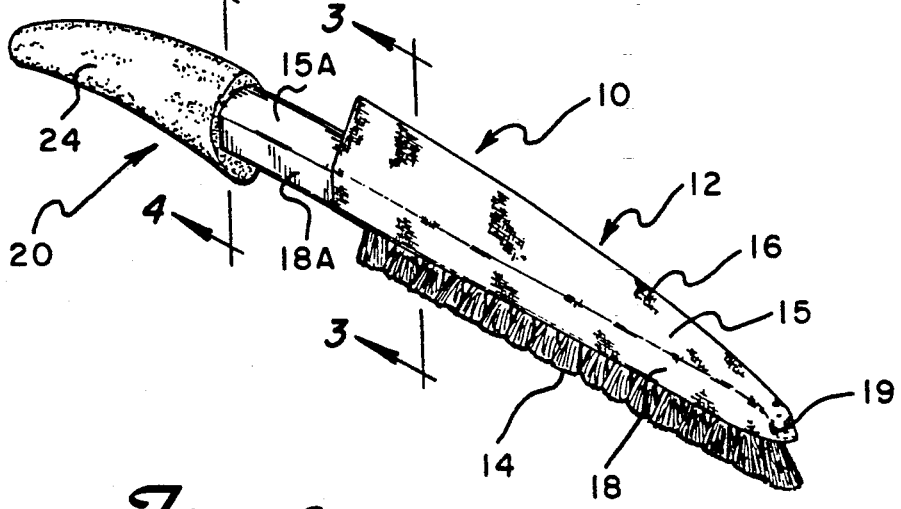
FIG. 1 is a top view in perspective of a car polishing tool in accordance with the invention.
Figure 3:
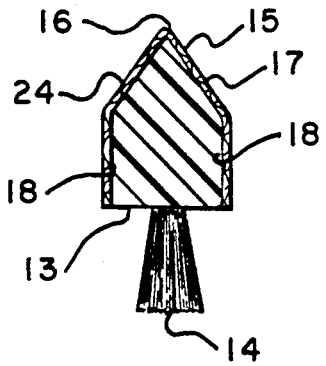
FIG. 3 is an enlarged sectional view taken along line 3—3 of FIG. 1.
Figure 2:
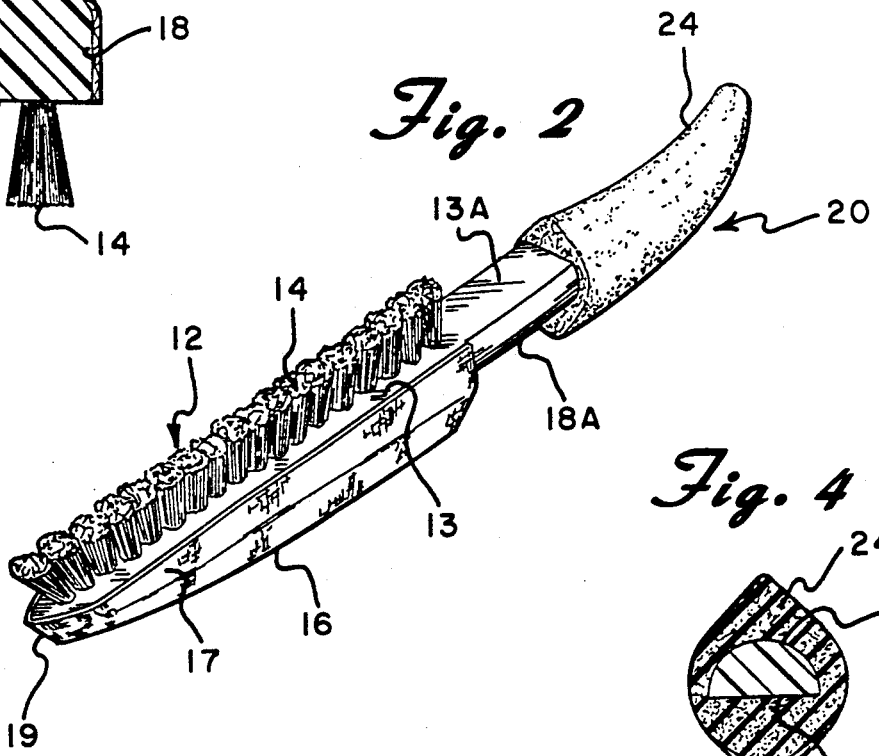
FIG. 2 is a perspective view of the opposite side of the tool shown in FIG. 1.
Figure 4:
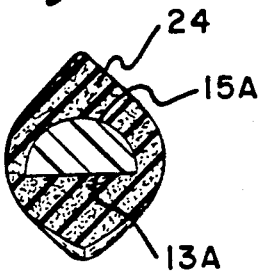
FIG. 4 is an enlarged sectional view taken along line 4—4 of FIG. 1.

Referring now to the drawing, where like reference numerals identify like parts, there is shown in FIGS. 1 to 4, by way of illustration, but not of limitation, a polishing tool in accordance with the invention shown generally as 10, which includes an elongated brush block 12 having a handle 20 integral therewith and extending axially from one end thereof and an absorbent material 24 mounted about the free end of the handle 20.

In the embodiment shown, the brush block 12 made by conventional methods from wood, plastic or the like has a substantially flat lower side 13 to which is secured a main body of outwardly projecting bristles 14 which are adapted for removing wax residue accumulations and other foreign matter from the outer surface of an automobile and are of a stiffness sufficient for doing so without causing damage to the painted or plated surfaces thereof. The opposite upper side 15 of the brush block is tapered outwardly to converge substantially centrally in a knife-like edge 16 extending the length of the brush block 12 in alignment with the longitudinal axis thereof. The knife-like edge 16 is also curved along its length from the end contiguous with the handle 20 downwardly towards the end opposite the handle 19 whereby the angle of convergence of the upper side 15 varies along the length of the brush block 12. There is thus provided a crevice-tool, the edges of which are more effectively adapted for the cleaning of accumulations of foreign matter including auto polish wax residue in crevices, corners and the like of varying sizes where it is generally impossible to gain access by the brushes, sponges and the like typically used in the cleaning and polishing of an auto surface.

The lateral sides 18 extending between the substantially flat under side 13 and the tapered upper side 15 of the brush block 12 terminate in a wedge-shaped end 19 opposite the handle which is oriented in axial alignment with the knife-like edge 16 along the upper side 15 of the brush block 12. Secured to the upper side 15 and lateral sides 18 of the brush block 12 by adhesive bonding or other conventional means is a sheet of soft cloth, felt-like material or the like 17 which is strong enough to withstand cleaning of the auto surface yet will not scratch or otherwise damage the painted and plated surfaces when the crevice tool is used to remove accumulated foreign matter.

In the embodiment shown, the handle 20 of the tool of the invention is integral with the brush block 12 and extends axially from one end thereof, although a separate handle can be secured to the end of the brush block 12 by conventional means. The lower side 13A and lateral sides 18A of the handle 20 extend from and comprise a continuation of the lower side 13 and lateral sides 18 of the brush block 12, while the opposite upper side 15A thereof is arcuate in configuration. All of such sides 13A, 15A and 18A of the handle 20 converge at the end opposite the brush block 12 to a rounded configuration. Mounted about the end of the handle 20 and a portion of the converging sides thereof is sheath of absorbent material 24, such as a sponge-like plastic adapted for the application of water and/or other cleaning, polishing or waxing compounds. The sheath of absorbent material 24 is secured to the handle by adhesive bonding or the like, or a preformed nose-shaped sheath of such absorbent material which can be releasably mounted about the end of the handle may also be used.

From the foregoing it should be readily apparent to those skilled in the art that the polishing tool structure 10 of the present invention having a main body of bristles and a crevice tool on opposites sides of a brush block and a handle which may be effectively adapted as a further cleaning medium, provides a unitary device which has a multitude of uses by simply reversing the head or the handle when in the process, for example, of cleaning and polishing the outside of a car. Moreover, the polishing tool 10 of the invention can be readily used without endangering the painted and plated surfaces thereof.

Having thus described the invention in relation to the drawings hereof, it will be clear that modifications could be made in the preferred embodiment without departing from the spirit of the invention. Accordingly, it is not intended that the words used to describe the invention be limiting thereof nor shout the drawings be considered so. It is intended that the invention be limited only by the scope of the appended claims.

What is claimed is:

1. A polishing tool suitable for removing accumulations of wax residue and other foreign matter from inaccessible areas of the exterior surface of an automobile comprising an elongated brush block having a handle projecting from an end of the brush block, said brush block having a substantially flat first lower side with a plurality of bristles projecting outwardly therefrom, a second upper side opposite said first lower side which second upperside is tapered outwardly to converge to a single outwardly projecting knife-like edge extending substantially centrally and axially along the second upper side, and lateral sides extending between said first side and said second side; and a polishing cloth means secured about the second side of said brush block.

2. The polishing tool as claimed in claim 1, wherein said handle is integral with said brush block.

3. The polishing tool as claimed in claim 1, wherein the lateral sides of said brush block at an end opposite said handle terminate substantially in the shape of a wedge oriented in axial alignment with said knife-like edge extending along said second side of the brush block.

4. The polishing tool as claimed in claim 3, wherein said knife-like edge extending axially along the second upper side of said brush block is curved from the end contiguous with said handle downwardly towards the first lower side at the end opposite said handle.

5. The polishing tool as claimed in claim 1, wherein said handle at an end opposite said brush block includes cleaning means.

6. The polishing tool as claimed in claim 5, wherein said handle terminates at the end opposite said brush block in a rounded nose-shaped end.

7. The polishing tool as claimed in claim 6, wherein said cleaning means is releasably mounted about the end of said handle.

8. An automobile polishing tool comprising:

(a) an elongated brush block having an end from which a handle projects and an opposite end terminating in a wedge-shape, an elongated first lower side from which a plurality of bristles project outwardly, an elongated second upper side opposite said first side and having an elongated knife-like edge extending essentially centrally of the second side and projecting downwardly therefrom, and a polishing cover means secured about said knife-like edge and second side;

(b) said handle having an end secured to the end of said brush block and an opposite free end about which is mounted absorbent cleaning medium.

9. The automobile polishing tool as claimed in claim 8, wherein said knife-like edge is provided by walls of said second side being tapered outwardly from opposite edges thereof, the direction of taper is such as to converge centrally above the brush block.

10. The automobile polishing tool as claimed in claim 9, wherein opposite elongated sides of said brush block extend laterally between said first side and said second side and merge at the end opposite said handle in a wedge-shape in axial alignment with said knife-like edge.

11. The automobile polishing tool as claimed in claim 10, wherein the knife-like edge has an angle of merger formed by the tapered walls of said second side which varies from the handle end of the brush block to the end opposite said handle end.

12. The automobile polishing tool as claimed in claim 11, wherein said polishing cover means is secured about said opposite laterally extending sides of said brush block.

13. The automobile polishing tool as claimed in claim 12, wherein said absorbent cleaning medium is releasably mounted about the free end of said handle.

14. The automobile polishing tool as claimed in claim 13, wherein said handle is integral with said brush block.

* * * * *